United States Patent [19]

Obadia

[11] Patent Number: 4,785,952

[45] Date of Patent: Nov. 22, 1988

[54] THERMOPLASTIC CAP WITH INTERNAL OXYGEN IMPERVIOUS SHEET AND PLASTISOL RING SEAL

[75] Inventor: Jacques Obadia, Paris, France

[73] Assignee: RICAL S.A., Longvic, France

[21] Appl. No.: 156,442

[22] Filed: Feb. 16, 1988

[30] Foreign Application Priority Data

Feb. 19, 1987 [FR] France ..... 87 02163

[51] Int. Cl.[4] ..... B65D 53/00

[52] U.S. Cl. ..... 215/329; 215/343; 215/347; 215/350

[58] Field of Search ..... 215/329, 347, 343, 341, 215/350, 348

[56] References Cited

U.S. PATENT DOCUMENTS 3,344,093 9/1967 Strickman ..... 215/348 X
3,930,589 1/1976 Koontz ..... 215/347 X
4,151,924 5/1979 Jameson ..... 215/347

FOREIGN PATENT DOCUMENTS 2378996 8/1978 France .
12631 of 1913 United Kingdom .

*Primary Examiner*—Donald F. Norton
*Attorney, Agent, or Firm*—Owen, Wickersham & Erickson

[57] ABSTRACT

Stopper device comprising a screw cap (1) made of oxygen-permeable, injection-moulded thermoplastic, whose bottom (2) is covered internally with an oxygen-impervious composite sheet (5) comprising a layer of paper (6) and a layer (8) of PVC and adhering to the bottom by virtue of the fact of the injection of the cap (1) onto the sheet (5), on the paper side, a plastisol seal (9) being cast on the sheet (5), on the PVC side, so as to adhere thereto after gelling.

5 Claims, 1 Drawing Sheet

THERMOPLASTIC CAP WITH INTERNAL OXYGEN IMPERVIOUS SHEET AND PLASTISOL RING SEAL

The present invention relates to a leakproof screw stopper device for receptacles such as bottles and jars containing alimentary or nonalimentary products which must be kept protected from oxygen, this device comprising a cup-shaped cap with a bottom and a skirt with an internal thread, the bottom of the cap having, in the vicinity of its connection to the skirt, a ring seal intended to function together with the edge of the mouth or neck of the receptacle and consisting of a plastisol cast in the liquid state and gelled.

Until now, stoppering devices for receptacles intended to contain products which must be kept protected from oxygen generally comprise a metal cap fitted internally with a seal made of plastisol (suspension of PVC resin in a plasticizer) or of similar materials, ensuring "mechanical" sealing between the bottom of the cap and the edge of the mouth or neck of the receptacle. The imperviousness of the stoppering device to oxygen is provided by the metal of the cap.

There is also known a stoppering device with a snap-fastening cap made of a flexible plastic such as polyethylene, this cap being provided at its bottom with a washer made of a PVC and paper composite. To manufacture this known cap, a washer made of composite is placed in a mould and the cap is formed by overmoulding the composite washer, and this ensures that this composite washer adheres directly to the polyethylene cap. In this known polyethylene cap, which is highly permeable to oxygen, the composite washer ensures the imperviousness of the stoppering device to oxygen.

There are also known screw stoppering devices comprising a cap made of a plastic such as polypropylene equipped with a ring seal made of plastisol provided on the bottom of the cap, in the vicinity of the connection between the bottom and the skirt of the cap. The plastic does not provide this cap with imperviousness to oxygen and, since the plastisol of the seal does not adhere to the polypropylene of the cap, it is necessary to provide an angular groove in the bottom of the capsule, intended to receive and to position the plastisol seal providing only "mechanical" sealing.

The subject of the present invention is a screw stopper-device of the type defined above comprising a cap which, while being less costly to manufacture than the mechanical caps, nevertheless ensures good imperviousness to oxygen and good "mechanical" sealing.

According to the invention, the cap is made of an oxygen-permeable, injection-moulded thermoplastic. The bottom of the cap is covered with a sheet of an oxygen-impervious composite comprising a layer of paper and a layer of PVC, the said sheet adhering to the bottom of the cap because of the overinjection of the cap onto the said sheet, on the paper side. A plastisol seal is cast on the said composite sheet, on the side of the PVC layer in the vicinity of the connection between the bottom and the skirt of the cap, so as to adhere to the PVC layer of the composite sheet after gelling.

In the cap according to the invention, the composite sheet adheres to the bottom of the cap without the use of adhesive, because of the fact that the cap is overinjected on the composite sheet, and the plastisol seal which ensures the mechanical sealing of the stoppering device adheres to the composite sheet because of the fact that the plastisol cast on the composite sheet is of the same kind as the PVC layer of this sheet.

The composite sheet preferably comprises a layer of paper coated with chlorinated rubber on one face and overcoated with a film of PVC on the coated face.

In order to improve further the imperviousness of the cap to oxygen, the composite sheet may additionally comprise a film of PVDC between the coated paper layer and the PVC film.

In order to ensure correct positioning of the plastisol seal which is cast in the liquid state, it is advantageous for the bottom of the cap to be concave:, that is to say to have a shape bulging inwards. Thus, when being cast on the bottom of the cap covered with the composite sheet, the plastisol is led into and kept with certainty in the region connecting the bottom to the skirt of the cap.

An illustrative embodiment of a stoppering device according to the invention will be described below in greater detail, without any limitation being implied, with reference to the attached drawings; in the drawings.

The stoppering device illustrated, intended to be fitted by screwing onto the mouth or neck of a receptacle, for example of a bottle or of a jar, preferably made of glass, comprises a cap 1 made of plastic, for example nucleated polypropylene. The cap 1 is made up of a concavely bulging bottom 2 and a substantially cylindrical skirt 3 comprising an internal thread 4 of the fast-pitch type.

Figure 1:
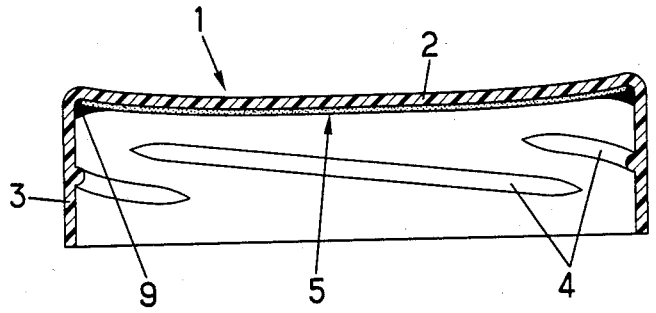
FIG. 1 is a section of a screw stopper cap according to the invention.
Figure 2:
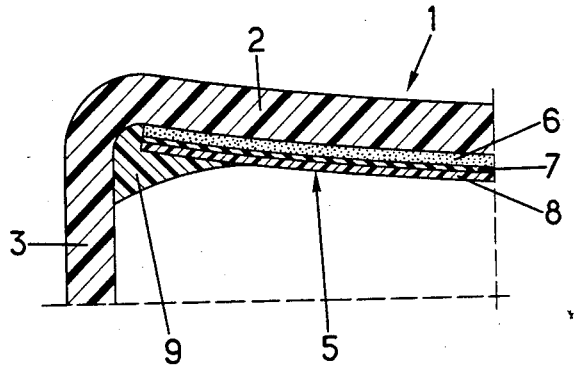
FIG. 2 is a partial section, on a larger scale, of the cap in FIG. 1 in the region connecting the bottom to the skirt.

The bottom 2 of the cap 1 is covered internally with a composite washer 5 comprising, according to FIG. 2, a layer of paper 6 coated, on the face away from the bottom 2 with a layer of chlorinated rubber 7 overcoated with a film 8 of PVC.

A plastisol seal 9 is added by casting onto the inner face of the bottom 2 covered by the washer 5, in the region connecting the bottom 2 to the skirt 3. After gelling, this plastisol seal adheres to the PVC sheet 8 of the washer 5, without any adhesive.

A preferred embodiment of the manufacture of a stoppering device 1 such as described above will now be described.

The composite washer 5 is first placed in an injection mould for the cap 1 and the plastic of the cap 1 is overinjected onto the washer 5, namely over the porous face of the layer of paper 6, so that the washer 5 adheres directly to the cap 1.

After demoulding of the cap 1 equipped with the composite washer 5, an annular bead of liquid plastisol, for example a plastisol such as is marketed by W. R. Grace and Co. under the trademark "Darawave", is cast in the upturned cap 1, in the vicinity of the connection of the bottom 2 to the skirt 3, on the PVC sheet 8 of the washer 5. After centrifuging, that is to say rotation of the cap around its axis of revolution in order to spread the plastisol properly as far as the skirt 3, the cap is passed through a gelling oven comprising a heating zone at approximately 155° C., followed by a microwave treatment zone.

On leaving the oven, the plastisol is in the form of a ring seal 9 of gelled plastisol adhering directly to the PVC sheet 8 of the washer 5 which itself adheres directly to the bottom 2 of the cap 1.

The cap 1 thus produced ensures, by virtue of the composite washer 5, an imperviousness to oxygen which is comparable with that of a metal cap, although the material of which the cap 1 itself consists (polypropylene) is highly permeable to oxygen, and a good mechanical seal in relation to the mouth or neck of the receptacle to be stoppered, by virtue of the plastisol seal 9 which compensates for the manufacturing faults and tolerances in the mouth of the receptacle.

In order to improve the imperviousness of the cap to oxygen further, it is possible to employ a composite sheet additionally comprising, for example, a layer of PVDC between the PVC sheet 8 and the rubber coating 7 of the paper layer 6.

Naturally, the cap 1 itself could also be made of a thermoplastic capable of being injection moulded, other than polypropylene, within the scope of the present invention.

I claim:

1. Leakproof screw stopper device for receptacles such as bottles and jars containing products which must be kept protected from oxygen, comprising a cup-shaped cap with a bottom and a skirt with an internal thread, the bottom of the cap having, in the vicinity of its connection to the skirt, a ring seal intended to function together with the edge of the mouth or neck of the receptacle and consisting of a plastisol cast in the liquid state and gelled, characterized in that the cap (1) is made of an oxygen-permeable, injection-moulded thermoplastic, that the bottom (2) of the cap is covered internally with an oxygen-impervious composite sheet (5) comprising a layer of paper (6) and a layer (8) of PVC and adhering to the bottom because of the injection of the cap onto the said sheet, on the paper side, and that the plastisol seal (9) is cast on the said composite sheet (5) on the PVC side so as to adhere to the PVC layer (8) after gelling.

2. Device according to claim 1, characterized in that the composite sheet (5) comprises a layer of paper (6) coated with chlorinated rubber (7) on one face and overcoated with a film (8) of PVC on the coated face.

3. Device according to claim 2, characterized in that the composite sheet additionally comprises a film of PVDC between the coated paper and the PVC film.

4. Device according to claim 1, characterized in that the bottom of the cap is concave in shape.

5. Device according to claim 1, characterized in that the cap is made of polypropylene.

* * * * *